US006533687B1

(12) United States Patent
Lee

(10) Patent No.: US 6,533,687 B1
(45) Date of Patent: Mar. 18, 2003

(54) STRING CLIP POSITIONING DEVICE OF A RACKET STRING STRETCHER

(76) Inventor: Min-Wei Lee, P.O. Box 55-124, Taichung (TW)

( * ) Notice: Subject to any disclaimer, the term of this patent is extended or adjusted under 35 U.S.C. 154(b) by 0 days.

(21) Appl. No.: 10/098,537

(22) Filed: Mar. 18, 2002

(51) Int. Cl.[7] ..... A63B 51/14
(52) U.S. Cl. ..... 473/557
(58) Field of Search ..... 473/557, 555, 473/556; 269/86, 166, 169

(56) References Cited

U.S. PATENT DOCUMENTS 5,090,697 A * 2/1992 Lee ..... 473/555
6,398,674 B2 * 6/2002 Tsuchida ..... 473/557

FOREIGN PATENT DOCUMENTS

FR 0148713 * 7/1985 ..... A63B/51/14

* cited by examiner

*Primary Examiner*—Raleigh W. Chiu

(57) ABSTRACT

A string clip positioning device of a racket string stretcher includes a slide seat, a pusher, a positioning member, and a track. The slide seat is mounted the track, and is provided with a seat tube which has a mounting section and a receiving section. The slide seat is formed with a chamber communicating with the receiving section of the seat tube. The positioning member is mounted on the slide seat, and includes a cap, and a clamping block. A support shaft is pivotally mounted in the mounting section of the seat tube. The pusher includes a push shaft pivotally connected with a link which is pivotally connected with the press handle of the string clip. A follower is mounted in the chamber of the slide seat, and includes a bearing wheel, a wheel seat, an adjusting threaded rod, and a drive block.

11 Claims, 6 Drawing Sheets

STRING CLIP POSITIONING DEVICE OF A RACKET STRING STRETCHER

BACKGROUND OF THE INVENTION

1. Field of the Invention

The present invention relates to a string clip positioning device of a racket string stretcher, and more particularly to a string clip positioning device of a racket string stretcher, wherein the string clip may be stopped and positioned efficiently.

2. Description of the Related Art

A conventional racket string stretcher in accordance with the prior art shown in FIG. 1 comprises a fixing seat "A" for fixing the racket, a base "C", a string clip "D", two slides 1', two guide tracks 2', two adjusting knobs 3', and two stop press handles 4'. The slide 1' may slide on the guide track 2' to a determined position. Then, the adjusting knob 3+ may be rotated to fix the slide 1'. Then, the stop press handle 4' may be pressed so that the string clip "D" may clip the string of the racket.

A conventional string clip positioning device for a racket string stretcher in accordance with the prior art shown in FIG. 2 comprises a disk 1 and a slide seat 2 mounted on the top and bottom of an elongated slot "C1" of the base "C" respectively, so that the slide 5 may be rotated freely and may slide in a rectangular track 3. The string clip 8 has a bottom provided with a shaft 7 that is mounted in a side end of the slide 5. A drive plate 6 is mounted in a bottom of the slide 5, and is pressed on a fulcrum 103 which is mounted on the top of the disk 1. A press rod 9 is mounted in the shaft 7, and is driven by a stop press handle 801 to press the drive plate 6. Thus, when the string clip 8 clips the string, the press rod 9 may be driven by the stop press handle 801 to press the drive plate 6 which presses the fulcrum 103, so that the bottom of the disk 1 may be urged on the top of the elongated slot "C1" of the base "C", thereby stopping movement of the slide 5.

When the press rod 9 presses the drive plate 6, the relative pressure between the press rod 9 and the drive plate 6 may force the flange 703 on the bottom of the shaft 7 to rest the end face 501 of the slide 5, thereby producing a static friction, so as to position the string clip 8, thereby preventing the string clip 8 from being rotated freely. At the same time, the drive plate 6 may press the fulcrum 103 of the disk 1, thereby positioning and stopping movement of the slide 5. However, the press rod 9 and the fixing rod 4 apply a downward force on the drive plate 6, and the fulcrum 103 of the disk 1 applies an upward force on the drive plate 6, thereby bending the drive plate 6, so that the drive plate 6 is easily deformed plastically during long-term utilization.

A nut 402 mounted on the bottom of the fixing rod 4 may be rotated, or an adjusting screw 902 mounted on the bottom of the press rod 9 may be rotated (after some of the parts are disassembled), so as to adjust the tension of the drive plate 6. However, the drive plate 6 is easily worn out during long-term utilization.

SUMMARY OF THE INVENTION

The present invention has arisen to mitigate and/or obviate the disadvantage of the conventional string clip positioning device of a racket string stretcher.

The primary objective of the present invention is to provide a string clip positioning device of a racket string stretcher, wherein the string clip may be stopped and positioned efficiently.

Another objective of the present invention is to provide a string clip positioning device of a racket string stretcher, wherein the bearing wheel is rolled on the surface of the guide face of the push block, so that the bearing wheel will not be deformed plastically, thereby enhancing the efficiency of stopping and positioning the string clip.

A further objective of the present invention is to provide a string clip positioning device of a racket string stretcher, wherein when the bearing wheel is rubbed by the surface of the guide face of the push block, the adjusting bolt of the adjusting threaded rod may maintain the reliability of stopping and positioning the string clip.

In accordance with the present invention, there is provided a string clip positioning device of a racket string stretcher, comprising a slide seat, a pusher, a positioning member, and a track, wherein:

the track is formed with an elongated guide slot;

the slide seat is mounted on a top of the track, and has a first end formed with an insertion hole and a second end provided with a seat tube which has an upper portion formed with a mounting section and a lower portion formed with a receiving section communicating with the mounting section, the slide seat is formed with a chamber communicating with the insertion hole and the receiving section of the seat tube;

the positioning member is mounted on the first end of the slide seat, and includes a cap received in the insertion hole of the slide seat, and a clamping block mounted on a bottom of the track, the cap of the positioning member has an outer wall formed with a tapered bearing face, and has a bottom end provided with an insertion block received in the guide slot of the slide seat, the clamping block of the positioning member has a top end provided with a connecting block received in the guide slot of the slide seat;

a support shaft is pivotally mounted in the mounting section of the seat tube of the slide seat, and has a bottom formed with an annular flange which is rested on a top face of the receiving section of the seat tube of the slide seat;

a string clip is mounted on the support shaft, and includes a press handle, and a link pivotally connected with the pusher, so that the support shaft and the positioning member may be operated synchronously, so as to stop and position the string clip;

the pusher includes a push shaft movably mounted in the support shaft, the push shaft of the pusher has a top end pivotally connected with a first end of the link which has a second end pivotally connected with the press handle of the string clip, so that the push shaft of the pusher may be moved by the link which is moved by the press handle, the pusher includes a push block secured on a bottom end of the push shaft;

a follower is mounted in the chamber of the slide seat, and includes a bearing wheel, a wheel seat, an adjusting threaded rod, and a drive block, wherein:

the bearing wheel of the follower is rotatably mounted on a first end of the wheel seat of the follower and partially extended into the receiving section of the seat tube of the slide seat;

the drive block of the follower has a first end rested on a second end of the wheel seat of the follower, and a second end formed with a tapered drive end that may contact the bearing face of the cap of the positioning member; and the adjusting threaded rod of the follower is screwed into the drive end of the drive block of the follower, and has a first end rested on the second end of the wheel seat of the follower.

Further benefits and advantages of the present invention will become apparent after a careful reading of the detailed description with appropriate reference to the accompanying drawings.

BRIEF DESCRIPTION OF THE DRAWINGS

FIG. 5A is a partially cut-away enlarged view of the string clip positioning device of a racket string stretcher as shown in FIG. 5.

DETAILED DESCRIPTION OF THE INVENTION

Figure 1:
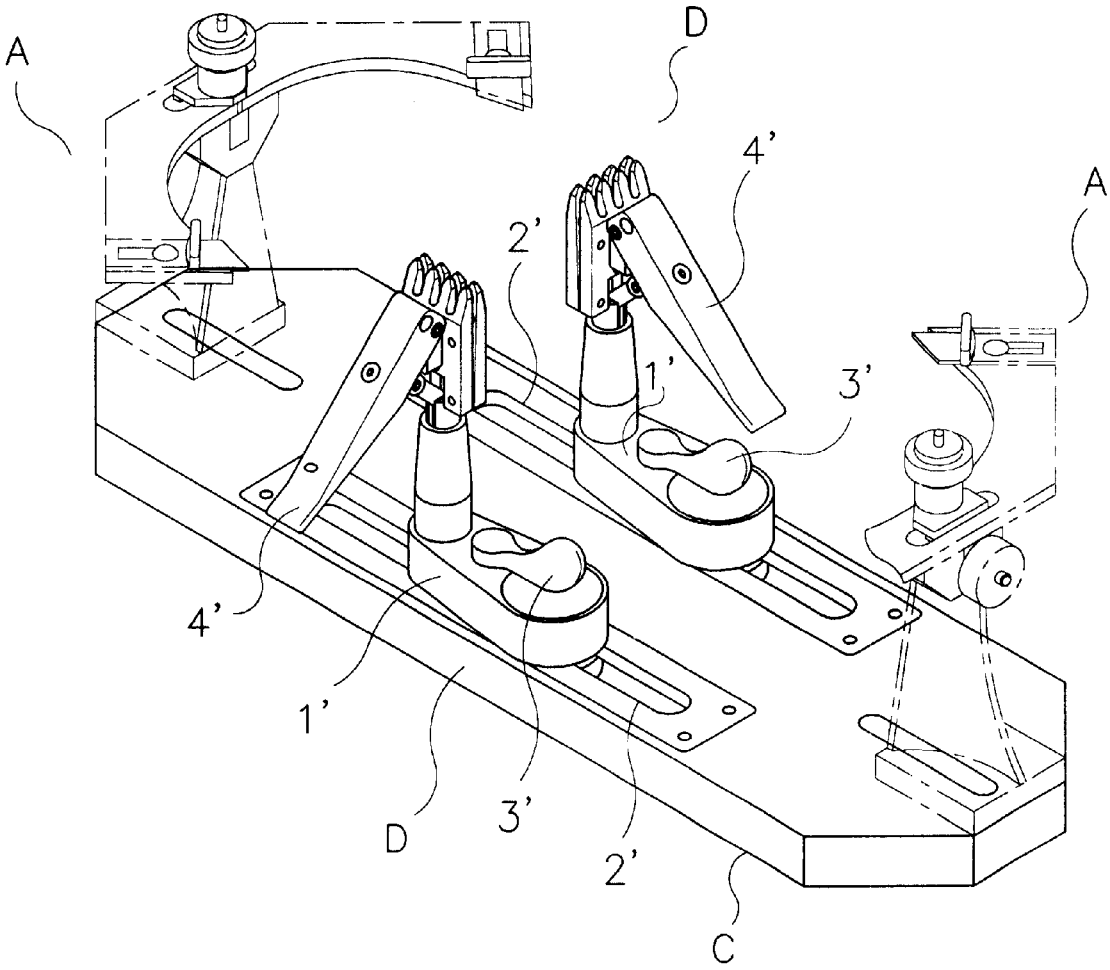
FIG. 1 PRIOR ART
FIG. 1 is a perspective view of a conventional racket string stretcher in accordance with the prior art.
Figure 2:
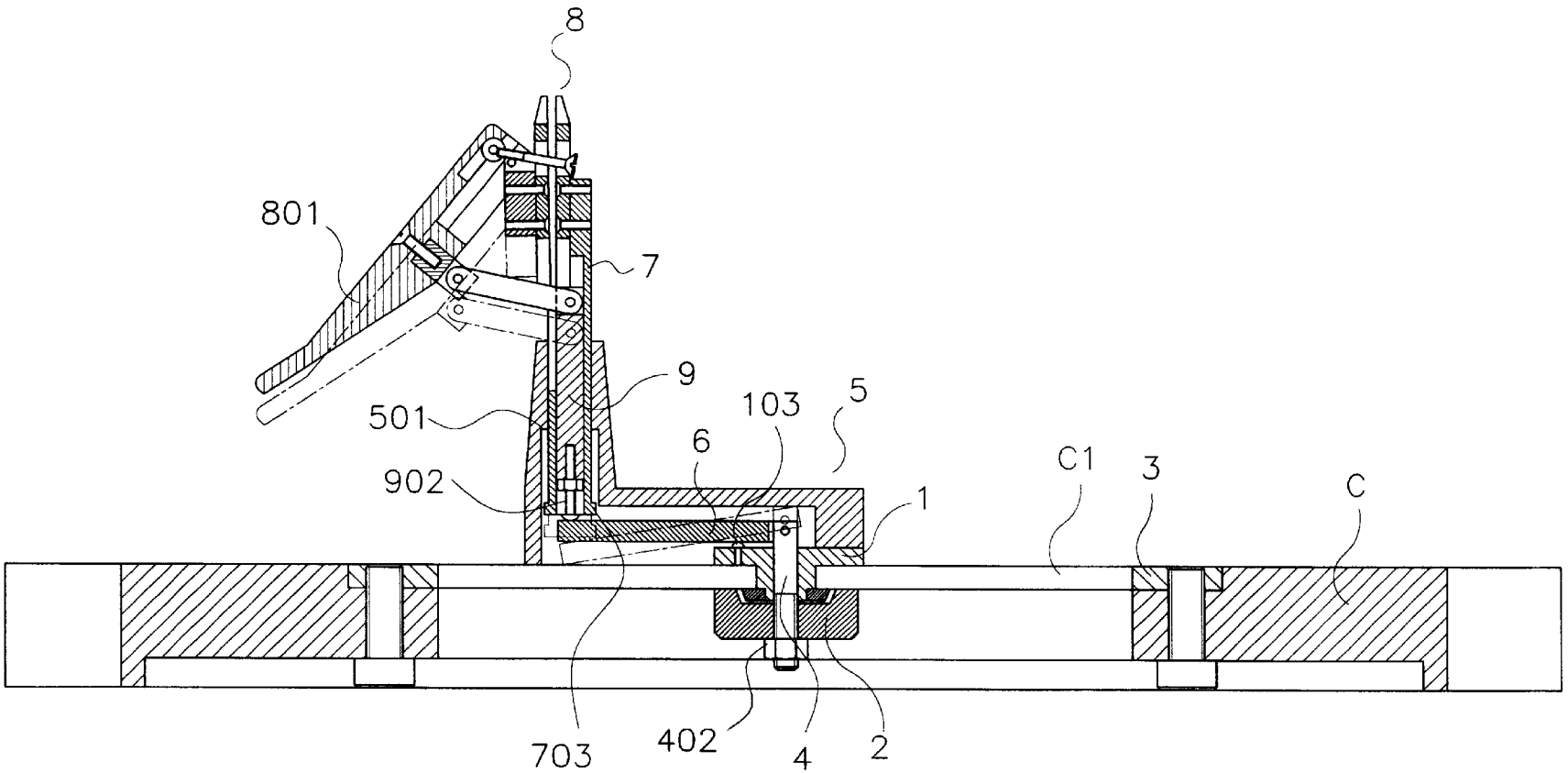
FIG. 2 PRIOR ART
FIG. 2 is a side plan cross-sectional assembly view of a conventional string clip positioning device of a racket string stretcher in accordance with the prior art.
Figure 3:
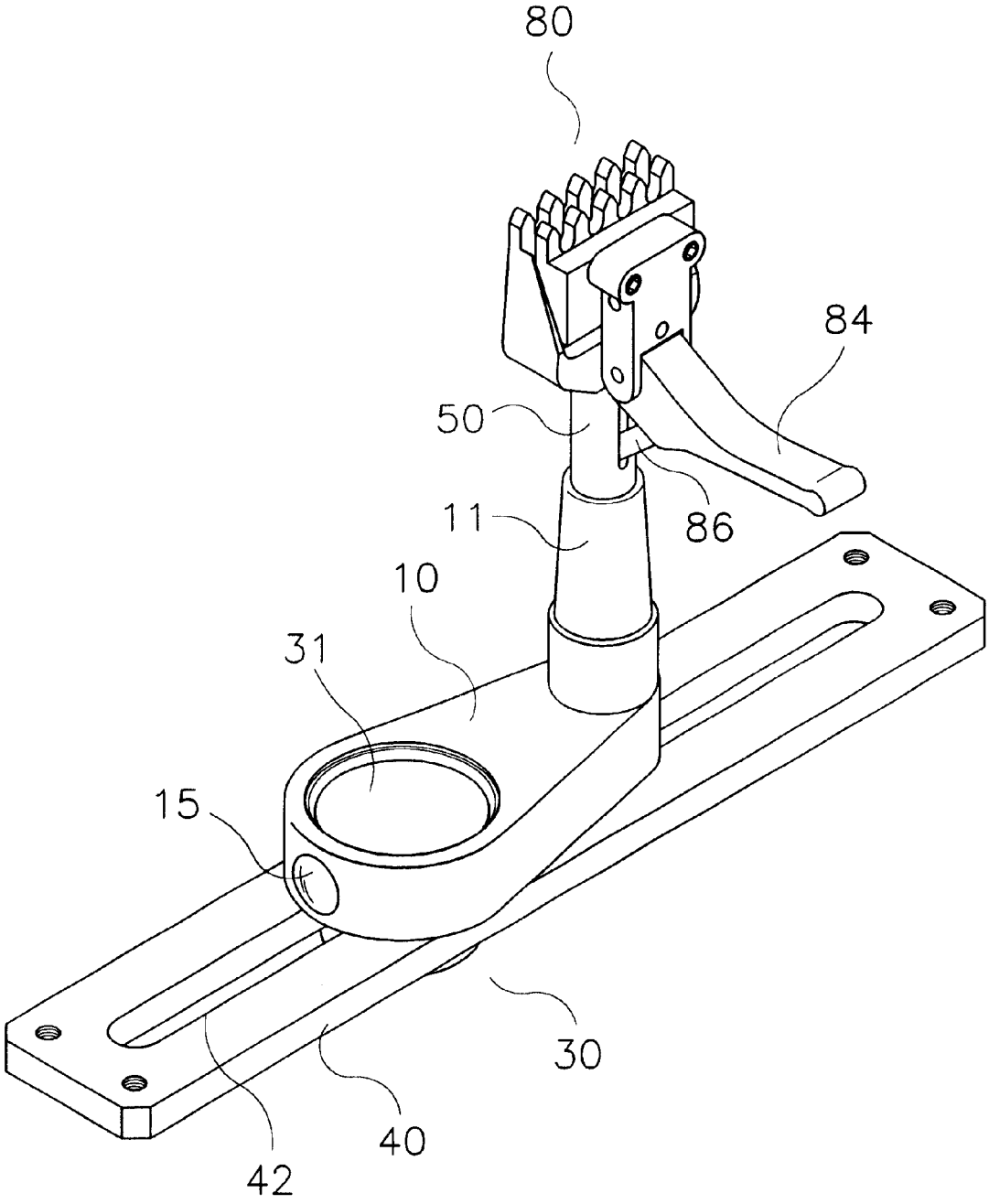
FIG. 3 is a perspective view of a string clip positioning device of a racket string stretcher in accordance with a preferred embodiment of the present invention.
Figure 4:
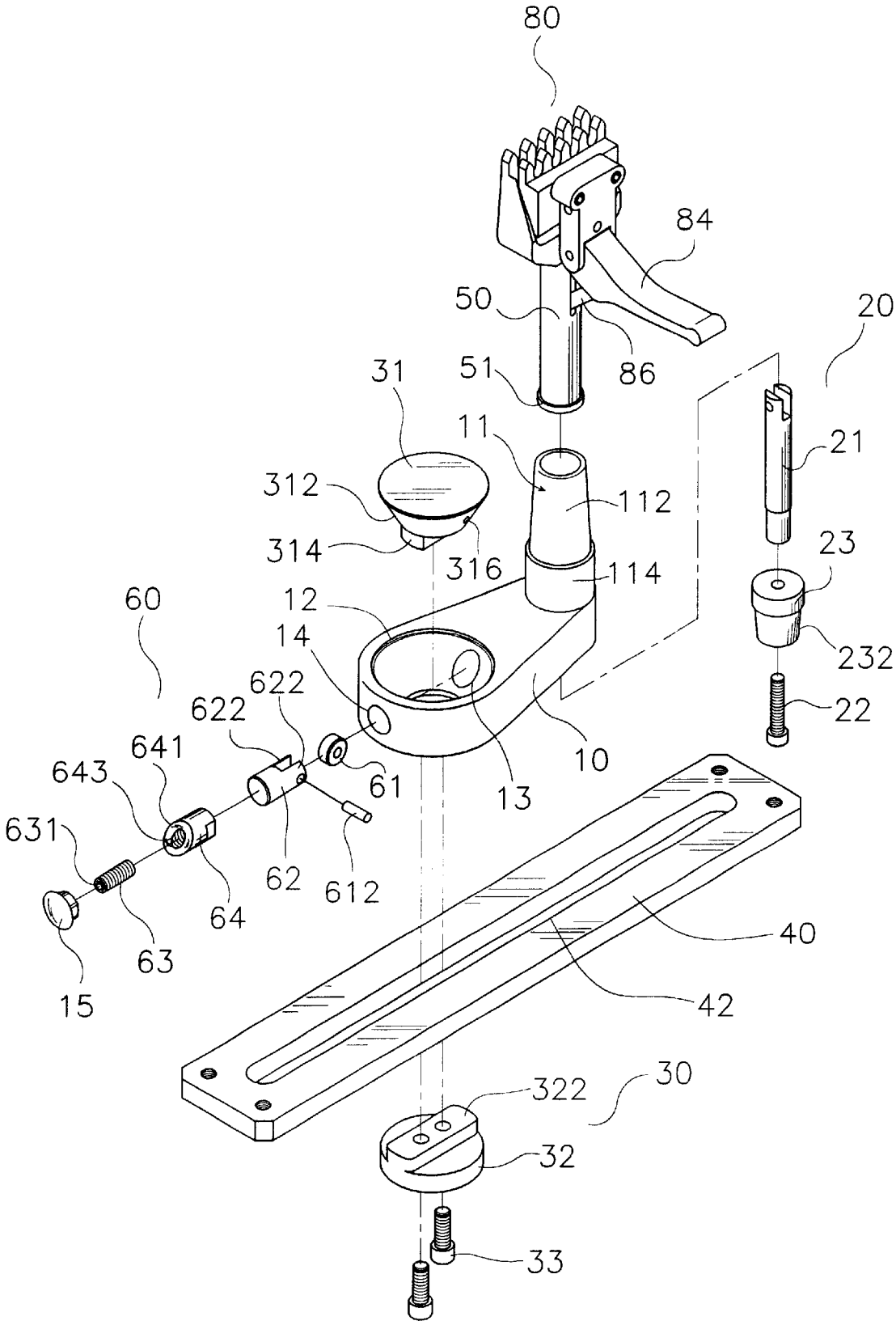
FIG. 4 is an exploded perspective view of a string clip positioning device of a racket string stretcher in accordance with a preferred embodiment of the present invention.
Figure 5:
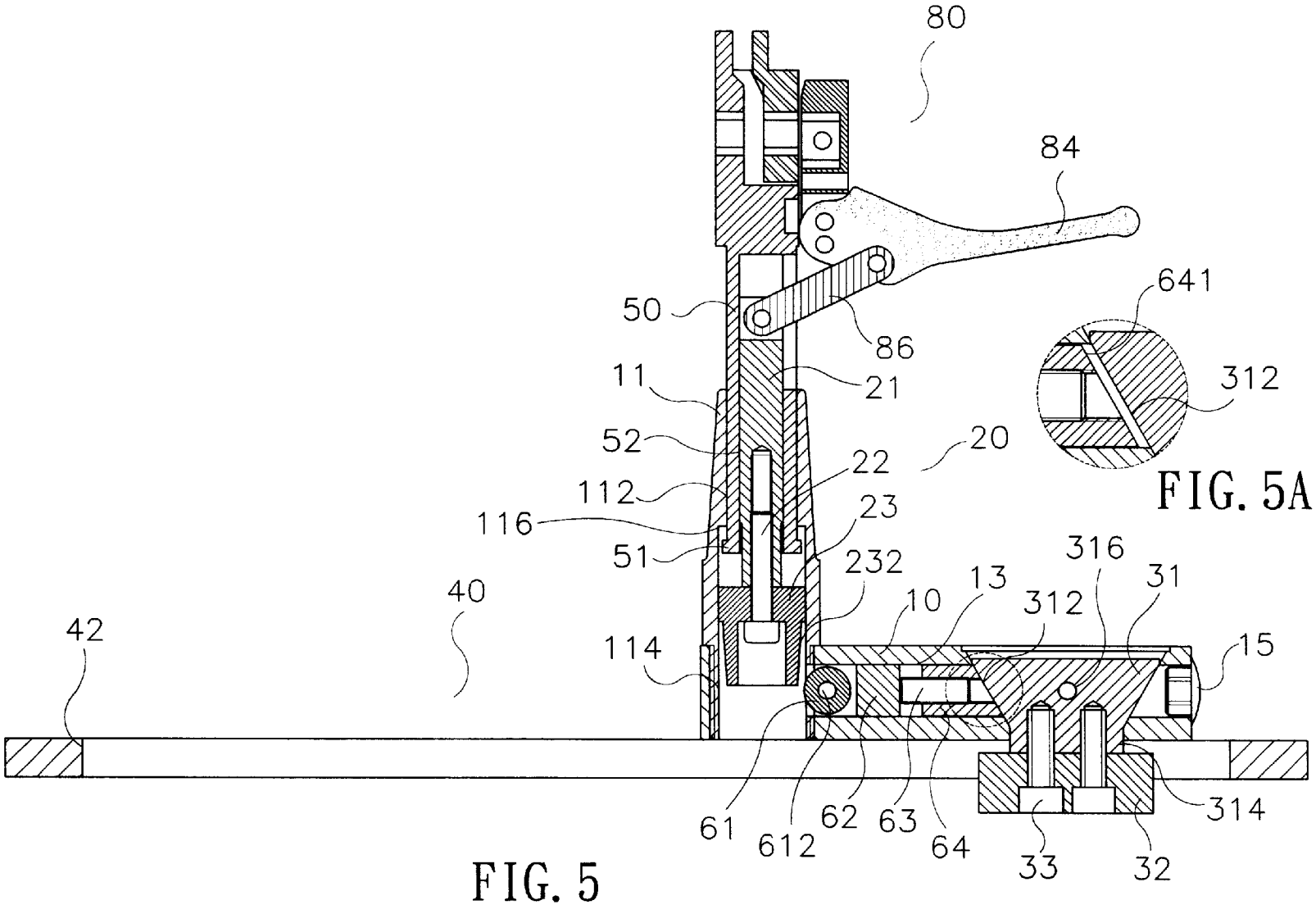
FIG. 5 is a side plan cross-sectional view of the string clip positioning device of a racket string stretcher as shown in FIG. 3.

Referring to the drawings and initially to FIGS. 3–5, a string clip positioning device of a racket string stretcher in accordance with a preferred embodiment of the present invention may be used in the racket of the tennis, the badminton or the like, and comprises a slide seat 10, a pusher 20, a positioning member 30, and a rectangular track 40.

The rectangular track 40 is secured in a top of a frame of the racket string stretcher, and is formed with an elongated guide slot 42.

The slide seat 10 is mounted on a top of the rectangular track 40, and may slide axially and reciprocally in the elongated guide slot 42 of the rectangular track 40.

The positioning member 30 is mounted on a first end of the slide seat 10, for stopping and positioning the slide seat 10.

The slide seat 10 has a second end provided with a seat tube II.

A string clip 80 has a bottom mounted on a support shaft 50 pivotally mounted in the seat tube 11 of the slide seat 10. The string clip 80 includes a press handle 84 pivotally connected with a link 86 which is pivotally connected with the pusher 20. Thus, the support shaft 50 and the positioning member 30 may be operated synchronously, so as to stop and position the string clip 80.

Referring to FIGS. 4 and 5, the seat tube 11 of the slide seat 10 has an upper portion formed with a mounting section 112 and a lower portion formed with a receiving section 114 communicating with the mounting section 112. The receiving section 114 has an inner diameter greater than that of the mounting section 112, thereby forming an annular shoulder 116 between the mounting section 112 and the receiving section 114.

The support shaft 50 is pivotally mounted in the mounting section 112 of the seat tube 11 of the slide seat 10, and has a bottom formed with an annular flange 51 which is received in the receiving section 114 of the seat tube 11 of the slide seat 10, and is rested on the annular shoulder 116 of the seat tube 11 of the slide seat 10, for positioning the angle of the string clip 80. The support shaft 50 has an inner wall axially formed with a through hole 52.

The pusher 20 includes a push shaft 21 movably mounted in the through hole 52 of the support shaft 50. The push shaft 21 of the pusher 20 has a top end pivotally connected with a first end of the link 86 of the string clip 80. The link 86 of the string clip 80 has a second end pivotally connected with the press handle 84 of the string clip 80, so that the push shaft 21 of the pusher 20 may be moved by the link 86 which is moved by the press handle 84.

The pusher 20 includes a push block 23 which is secured on a bottom end of the push shaft 21 by a bolt 22, and is movably mounted in the receiving section 114 of the seat tube 11 of the slide seat 10. The push block 23 of the pusher 20 has an outer wall formed with a tapered guide face 232.

The positioning member 30 includes a circular cap 31, and a clamping block 32. The circular cap 31 of the positioning member 30 has an outer wall formed with a tapered bearing face 312. The circular cap 31 of the positioning member 30 has a bottom end provided with a rectangular insertion block 314 received in the guide slot 42 of the slide seat 10. The first end of the slide seat 10 is formed with a tapered insertion hole 12 for receiving the circular cap 31 of the positioning member 30. The clamping block 32 of the positioning member 30 is a circular disk, and has a top end provided with a rectangular connecting block 322 received in the guide slot 42 of the slide seat 10. The cap 31 and the clamping block 32 of the positioning member 30 are combined with each other by multiple adjusting bolts 33, so that the slide seat 10 and the track 40 may be clamped by the cap 31 and the clamping block 32 of the positioning member 30, thereby positioning the slide seat 10.

The slide seat 10 is formed with a chamber 13 communicating with the insertion hole 12 and in the receiving section 114 of the seat tube 11 of the slide seat 10.

A follower 60 is mounted in the chamber 13 of the slide seat 10, and includes a bearing wheel 61, a wheel seat 62, an adjusting threaded rod 63, and a drive block 64.

The wheel seat 62 of the follower 60 has a first end provided with two spaced ears 622. The bearing wheel 61 of the follower 60 is pivotally mounted between the two spaced ears 622 of the wheel seat 62 by a wheel axle 612. The bearing wheel 61 of the follower 60 is partially extended into the receiving section 114 of the seat tube 11 of the slide seat 10. Thus, the push block 23 of the pusher 20 may be moved to contact and press the bearing wheel 61 of the follower 60 to push and drive the wheel seat 62 of the follower 60 to move axially.

The drive block 64 of the follower 60 has a first end rested on a second end of the wheel seat 62 of the follower 60, and a second end formed with a tapered drive end 641 that may contact the bearing face 312 of the cap 31 of the positioning member 30. The drive end 641 of the drive block 64 of the follower 60 is axially formed with a screw bore 643.

The adjusting threaded rod 63 of the follower 60 is screwed into the screw bore 643 of the drive end 641 of the drive block 64 of the follower 60, and has a first end rested on the second end of the wheel seat 62 of the follower 60, and a second end formed with a hexagonal insertion recess 631. The adjusting threaded rod 63 of the follower 60 may be rotated to adjust the width of the bearing wheel 61 of the follower 60 protruding into the receiving section 114 of the seat tube 11 of the slide seat 10.

The circular cap 31 of the positioning member 30 is axially formed with a first working hole 316 which is vertical to the axial direction of the chamber 13 of the slide seat 10. The first working hole 316 of the circular cap 31 of the positioning member 30 is not connected to the chamber 13 of the slide seat 10 due to blockage of the wall of the circular cap 31 of the positioning member 30.

The first end of the slide seat 10 is formed with a second working hole 14 communicating with the tapered insertion hole 12 and aligning with the chamber 13. Thus, a hand tool may be extended through the second working hole 14 into the chamber 13 to rotate and adjust the adjusting threaded rod 63 of the follower 60. A seal cover 15 is mounted in the second working hole 14.

In assembly, the slide seat 10, the support shaft 50, the pusher 20 and the follower 60 may be assembled initially, and the string clip 80 is locked on the support shaft 50. Then, the cap 31 is inserted into the insertion hole 12, and is rotated, so that the first working hole 316 of the circular cap 31 of the positioning member 30 is connected to the chamber 13 and the second working hole 14 of the slide seat 10.

At this time, a hand tool may be extended through the second working hole 14 and the first working hole 316 into the chamber 13 to rotate and adjust the adjusting threaded rod 63 of the follower 60, so that the adjusting threaded rod 63 of the follower 60 may be rotated to adjust the width of the bearing wheel 61 of the follower 60 protruding into the receiving section 114 of the seat tube 11 of the slide seat 10.

After adjustment, the hand tool may be removed, and the cap 31 may be rotated, thereby interrupting the connection between the first working hole 316 of the circular cap 31 of the positioning member 30 and the chamber 13 and the second working hole 14 of the slide seat 10.

Then, the slide seat 10 may be mounted on the track 40, and the insertion block 314 of the cap 31 may be inserted into the guide slot 42 of the slide seat 10. Then, the connecting block 322 of the clamping block 32 may be inserted into the guide slot 42 of the slide seat 10. The cap 31 and the clamping block 32 of the positioning member 30 are combined with each other by the multiple adjusting bolts 33, so that the slide seat 10 and the track 40 may be limited by the cap 31 and the clamping block 32 of the positioning member 30, and the slide seat 10 may slide on the track 40 easily and freely. Finally, the seal cover 15 is mounted in the second working hole 14.

Figure 6:
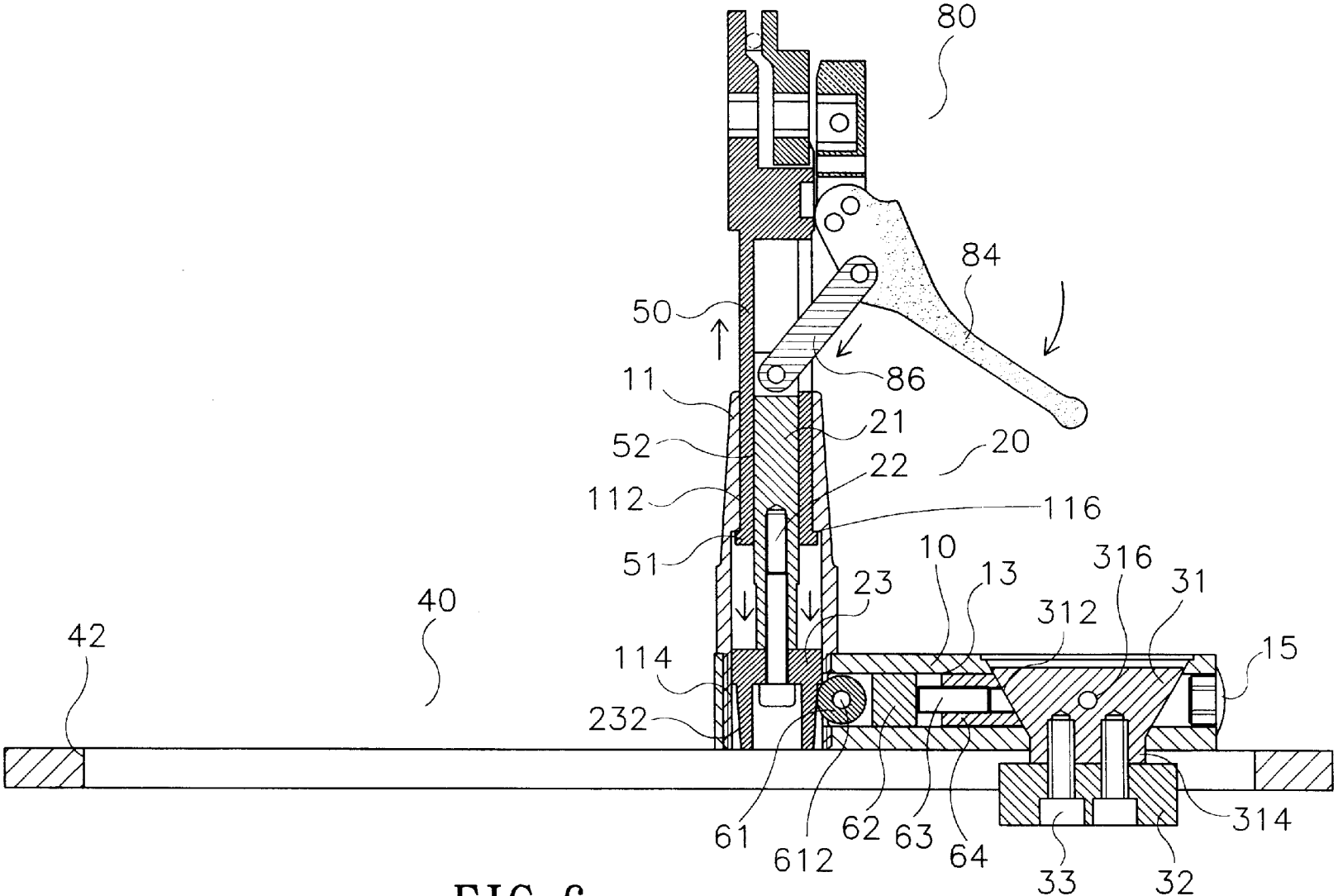
FIG. 6 is a schematic operational view of the string clip positioning device of a racket string stretcher as shown in FIG. 5 in use.

In operation, referring to FIGS. 4–6, during the string stretching process of the racket, when the string clip 80 is moved to a determined position to hold the string of the racket, the press handle 84 may be pressed downward, to move the link 86 which drive the push shaft 21 of the pusher 20 to move downward, thereby moving the push block 23 of the pusher 20 downward, whereby the guide face 232 of the push block 23 may push the bearing wheel 61 to move inward, so that the follower 60 may be moved toward the cap 31 of the positioning member 30. Thus, the cap 31 of the positioning member 30 may be slightly moved upward by the drive block 64, so that the top face of the clamping block 32 may be closely urged on the bottom of the track 40, thereby stopping and positioning the slide seat 10 without movement.

At this time, the top face of the clamping block 32 is closely urged on the bottom of the track 40, and the cap 31 of the positioning member 30 cannot be moved upward any more, so that the bearing wheel 61 cannot be extended into the chamber 13 any more. Thus, if the press handle 84 is pressed downward successively, the bearing wheel 61 will produce a reaction to resist the downward force of the push block 23 of the pusher 20, so that the support shaft 50 is moved upward. When the press handle 84 is pressed downward to a dead point as shown in FIG. 6, the annular flange 51 of the support shaft 50 received in the receiving section 114 of the seat tube 11 of the slide seat 10 is rested on the annular shoulder 116 of the seat tube 11 of the slide seat 10, thereby producing a static friction between the annular flange 51 of the support shaft 50 and the annular shoulder 116 of the seat tube 11 of the slide seat 10, for positioning the angle of the string clip 80, so that the string clip 80 may be stopped and positioned.

Accordingly, by the string clip positioning device of a racket string stretcher in accordance with a preferred embodiment of the present invention, the string clip 80 may be stopped and positioned efficiently. In addition, the bearing wheel 61 is rolled on the surface of the guide face 232 of the push block 23, so that the bearing wheel 61 will not be deformed plastically, thereby enhancing the efficiency of stopping and positioning the string clip 80. Further, when the bearing wheel 61 is rubbed by the surface of the guide face 232 of the push block 23, the adjusting bolts 33 of the adjusting threaded rod 63 may maintain the reliability of stopping and positioning the string clip 80.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A string clip positioning device of a racket string stretcher, comprising a slide seat, a pusher, a positioning member, and a track, wherein:

the track is formed with an elongated guide slot;

the slide seat is mounted on a top of the track, and has a first end formed with an insertion hole and a second end provided with a seat tube which has an upper portion formed with a mounting section and a lower portion formed with a receiving section communicating with the mounting section, the slide seat is formed with a chamber communicating with the insertion hole and the receiving section of the seat tube;

the positioning member is mounted on the first end of the slide seat, and includes a cap received in the insertion hole of the slide seat, and a clamping block mounted on a bottom of the track, the cap of the positioning member has an outer wall formed with a tapered bearing face, and has a bottom end provided with an insertion block received in the guide slot of the slide seat, the clamping block of the positioning member has a top end provided with a connecting block received in the guide slot of the slide seat;

a support shaft is pivotally mounted in the mounting section of the seat tube of the slide seat, and has a bottom formed with an annular flange which is rested on a top face of the receiving section of the seat tube of the slide seat;

a string clip is mounted on the support shaft, and includes a press handle, and a link pivotally connected with the pusher, so that the support shaft and the positioning member may be operated synchronously, so as to stop and position the string clip;

the pusher includes a push shaft movably mounted in the support shaft, the push shaft of the pusher has a top end pivotally connected with a first end of the link which has a second end pivotally connected with the press handle of the string clip, so that the push shaft of the pusher may be moved by the link which is moved by the press handle, the pusher includes a push block secured on a bottom end of the push shaft;

a follower is mounted in the chamber of the slide seat, and includes a bearing wheel, a wheel seat, an adjusting threaded rod, and a drive block, wherein:

the bearing wheel of the follower is rotatably mounted on a first end of the wheel seat of the follower and partially extended into the receiving section of the seat tube of the slide seat;

the drive block of the follower has a first end rested on a second end of the wheel seat of the follower, and a second end formed with a tapered drive end that may contact the bearing face of the cap of the positioning member; and the adjusting threaded rod of the follower is screwed into the drive end of the drive block of the follower, and has a first end rested on the second end of the wheel seat of the follower.

2. The string clip positioning device of a racket string stretcher in accordance with claim 1, wherein the guide face of the push block of the pusher has tapered shape, and the cap of the positioning member has a tapered shape.

3. The string clip positioning device of a racket string stretcher in accordance with claim 1, wherein the push block of the pusher is secured on the bottom end of the push shaft by a bolt.

4. The string clip positioning device of a racket string stretcher in accordance with claim 1, wherein the wheel seat of the follower has a first end provided with two spaced ears, and the bearing wheel of the follower is pivotally mounted between the two ears of the wheel seat by a wheel axle.

5. The string clip positioning device of a racket string stretcher in accordance with claim 1, wherein the circular cap of the positioning member is axially formed with a first working hole which is vertical to the axial direction of the chamber of the slide seat, the first working hole of the circular cap of the positioning member is not connected to the chamber of the slide seat due to blockage of the wall of the circular cap of the positioning member, the first end of the slide seat is formed with a second working hole communicating with the tapered insertion hole and aligning with the chamber, whereby a hand tool may be extended through the second working hole into the chamber to rotate and adjust the adjusting threaded rod of the follower.

6. The string clip positioning device of a racket string stretcher in accordance with claim 5, wherein the follower includes a seal cover mounted in the second working hole.

7. The string clip positioning device of a racket string stretcher in accordance with claim 1, wherein the receiving section has an inner diameter greater than that of the mounting section, thereby forming an annular shoulder between the mounting section and the receiving section.

8. The string clip positioning device of a racket string stretcher in accordance with claim 1, wherein the drive end of the drive block of the follower is axially formed with a screw bore, and the adjusting threaded rod of the follower is screwed into the screw bore of the drive end of the drive block of the follower.

9. The string clip positioning device of a racket string stretcher in accordance with claim 1, wherein the adjusting threaded rod of the follower has a second end formed with a hexagonal insertion recess, so that the adjusting threaded rod of the follower may be rotated to adjust the width of the bearing wheel of the follower protruding into the receiving section of the seat tube of the slide seat.

10. The string clip positioning device of a racket string stretcher in accordance with claim 1, wherein the cap and the clamping block of the positioning member are combined with each other by multiple adjusting bolts, so that the slide seat and the track may be retained by the cap and the clamping block of the positioning member, thereby positioning the slide seat.

11. The string clip positioning device of a racket string stretcher in accordance with claim 1, wherein the push block of the pusher has an outer wall formed with a tapered guide face.

* * * * *